United States Patent [19]

Kopp

[11] Patent Number: 4,907,801

[45] Date of Patent: Mar. 13, 1990

[54] REBOUND BASEBALL TRAINING APPARATUS

[76] Inventor: Harold W. Kopp, 137 Daytona Ave., Narragansett, R.I. 02882

[21] Appl. No.: 245,702

[22] Filed: Sep. 19, 1988

[51] Int. Cl.[4] ..... A63B 69/40

[52] U.S. Cl. ..... 273/26 R

[58] Field of Search ..... 273/26 R, 29 A, 29 R, 273/58 C, 184 B, 181 J, 176 FB, 185 D, 196, 197 R, 197 A, 35 R, 182 R; 272/76

[56] References Cited

U.S. PATENT DOCUMENTS

| | | | |
|---|---|---|---|
| 805,543 | 11/1905 | Hayes | 272/76 |
| 1,170,467 | 2/1916 | Taylor | 272/76 |
| 1,491,252 | 2/1935 | Kane | 273/196 |
| 2,695,175 | 11/1954 | Trapp | 273/196 |
| 3,329,428 | 7/1967 | Moran | 273/55 R |
| 3,365,947 | 1/1968 | Janich, III et al. | 273/55 R |
| 3,674,265 | 7/1972 | Sheets et al. | 273/55 R |
| 3,873,089 | 3/1975 | Krug | 273/55 |
| 4,042,237 | 8/1977 | Moraru | 273/29 A |
| 4,067,571 | 1/1978 | Rogers | 273/55 R |
| 4,477,076 | 10/1984 | Monaco | 273/55 |

*Primary Examiner*—T. Brown

*Attorney, Agent, or Firm*—Charles S. McGuire

[57] ABSTRACT

A device for training and conditioning players in the hitting of a baseball. A conventional baseball is fixedly attached to the end of an elongated member which is slideably received in a hollow tube. The tube is supported in a substantially horizontal position on the end of a support rod which is vertically adjustable to place the baseball at a desired height, and rotationally adjustable to place the axis of the slide member at a desired angle with respect to the hitter. A coil spring within the closed end of the horizontal tube returns the slide member to its original position after being struck, and thus caused to move forcefully into the tube. The support rod, preferably two telescoping rods, is fixedly attached at its lower end to a flat support plate which rests on a horizontal surface during use of the device.

7 Claims, 3 Drawing Sheets

REBOUND BASEBALL TRAINING APPARATUS

BACKGROUND OF THE INVENTION

The present invention relates to sports training apparatus and, more specifically, to rebound-type training devices for baseball.

In the sport of baseball a player must impart a forceful blow to a baseball which has been propelled toward him at high speed. Using a bat, the hitter must execute a coordinated swing for a successful hit of the ball into the field. The angle and height at which the ball enters the strike zone is determinative of the respective angle and height at which the hitter will swing his bat, in addition to where the hitter wishes to place the hit ball. Although general body strength and endurance are necessary, certain specific muscles or muscle groups are primarily employed in imparting the hit to the ball through the successful swing of the bat.

In conventional sports conditioning, athletes engage in various exercises, either with or without the use of weights or other exercise apparatus, designed to strengthen the muscles of primary importance in a particular sport. Also, in baseball, athletes practice hitting the baseball to increase their manipulative skills while at the same time strengthening the muscles so used. It is difficult, however, to achieve a rapid and sustained repetition of practice hits, which is desirable for training purposes, since the ball must be thrown and retrieved or replaced after it is hit by the trainee.

It is a typical feature of sports training apparatus for sports involving a game object which is propelled toward a player, to include means for rapid rebound of the game object to the athlete such that the athlete or trainee may execute a sustained repetition of practice hits without having to retrieve or replace the game object every time it is hit. For example, U.S. Pat. Nos. 4,070,017 and 3,955,815, issued to Lombardi on Jan. 24, 1978 and to Deschesnes on May 11, 1976, respectively, disclose hockey training apparatus which include means to return the hit puck to its initial position. Also, U.S. Pat. No. 4,516,769, issued to applicant herein on May 14, 1985, discloses rebound sports training apparatus including means to return the hit game object to the trainee. Although similar in principle of operation to the above mentioned patent documents, the present invention is designed specifically for training in the sport of baseball, incorporating elements to simulate the proper positioning of a baseball to be hit by a player with a baseball bat.

It is a principal object of the present invention to provide novel and improved apparatus for training baseball athletes wherein optimum conditioning is provided for the muscles or muscle groups primarily used in imparting a hit to a baseball while at the same time improving manipulative skills by striking the baseball in substantially the same manner as in a game.

Another object is to provide rebound sports training equipment wherein a baseball attached to the equipment is quickly and automatically returned to its original position after being struck by a trainee, permitting rapid and sustained repetition of hits to the baseball, exercising the necessary muscle groups in a manner closely simulating actual game conditions.

A still further object is to provide a baseball training aid adapted for repeated, forceful hits to a baseball which is of extremely durable and structurally sound design.

Other objects will in part be obvious and in part appear hereinafter.

SUMMARY OF THE INVENTION

In furtherance of the foregoing objects, the invention contemplates baseball training apparatus having a base support structure including a flat metal plate with a weight receiving post welded or otherwise attached thereto and a first, elongated hollow support rod, open at one end, in a fixed vertical position thereon. A second support rod extends loosely through the first support rod for reciprocal, sliding movement with respect thereto. Stop means such as peripheral clamping knobs are affixed to the first rod support such that the second support rod may be selectively fixed at a predetermined height, and also selectively rotated a predetermined number of degrees with respect to the first rod support in accordance with the trainee's particular needs.

A hollow, elongated tube having one open end is perpendicularly and fixedly mounted to the upper end of a sleeve which, in turn, is mounted to the upper end of the second support rod such that the tube lies in an essentially horizontal plane upon the desirable placing of the metal support plate on a horizontal surface. An elongated slide member, such as a solid bar or rod, of an essentially rigid but somewhat flexible material, extends into the open end of the tube for telescoping and reciprocal, sliding movement, limited in the forward direction by a peripheral flange and bumper and in the return direction by a fixed pin extending from the elongated slide member through an elongated slot in the tube. The baseball to which the propelling force is applied during the training is fixedly attached by appropriate means to the outer end of the slide member.

In operation, the apparatus is adjusted to place the ball at the desired height and angle with respect to the batter. With the slide member at its outer position of travel, the batter applies a blow to the baseball with a bat in substantially the same manner and with the same motion as in actual game conditions. The slide member travels within the tube until reaching the inner limit of its travel, where contact with a spring attached at one end to the inside, closed end portion of the tube precedes contact of the stop means with the tube. The slide member's contact with the spring causes the slide member to rebound to its outer or initial position. Outward movement of the slide member is abruptly stopped by contact of the pin thereon with the end of the elongated slot in the tube.

Thus, the elements are returned to their original positions by the rebound action provided by the spring. Also, there is no significant rebound action when the slide member reaches its original, forward position due to the stop means employed. The rebound action is extremely quick and repeated propelling hits may be applied to the baseball virtually as fast as the trainee is able to apply the blow thereto.

DETAILED DESCRIPTION

Figure 1:
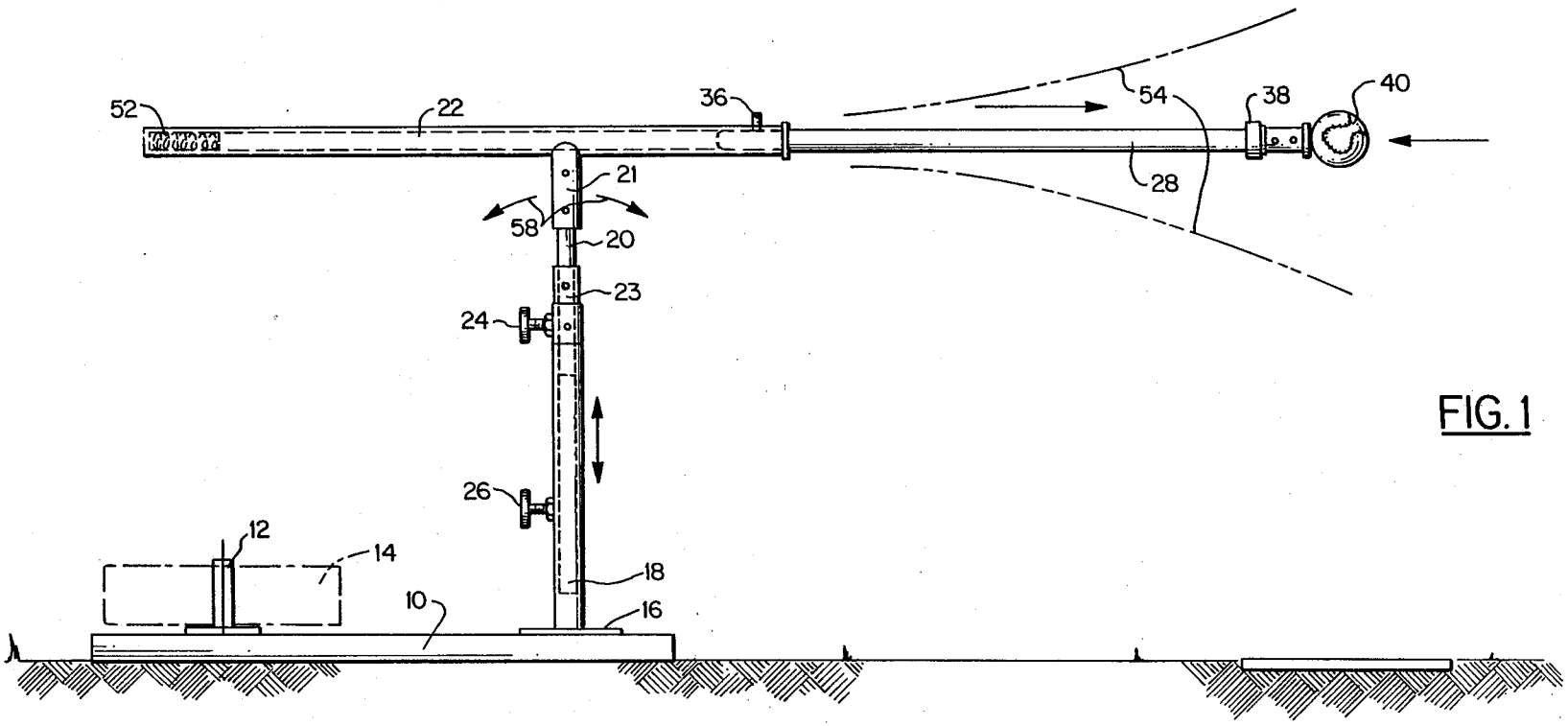
FIG. 1 is a side elevational view of the preferred embodiment of the invention, showing the movable element in a first position.

Referring now to the drawings, the training apparatus of the invention includes a base support structure having a flat, rectangular, metal plate 10, intended to rest on a substantially horizontal support surface while the apparatus is in use in its principal anticipated application. Post 12 is affixed to plate 10, extending upwardly therefrom for accepting weights with central openings as shown in phantom lines in FIG. 1 and indicated by reference numeral 14. The immovable or fixed portions of the base structure further include support plate 16 welded or otherwise affixed to plate 10 to provide support and structural stability to a first elongated hollow support rod 18, vertically fixed thereon. Second elongated support rod 20 extends coaxially into first support rod 18. Sleeve portions 21 and 23 are riveted or otherwise attached to opposite ends of support rod 20. Sleeve 23 is freely slidable in rod 18 in both directions, being releasably fixed in a desired vertical position by means of set screws extending from clamping knobs 24 and 26.

Figure 3:
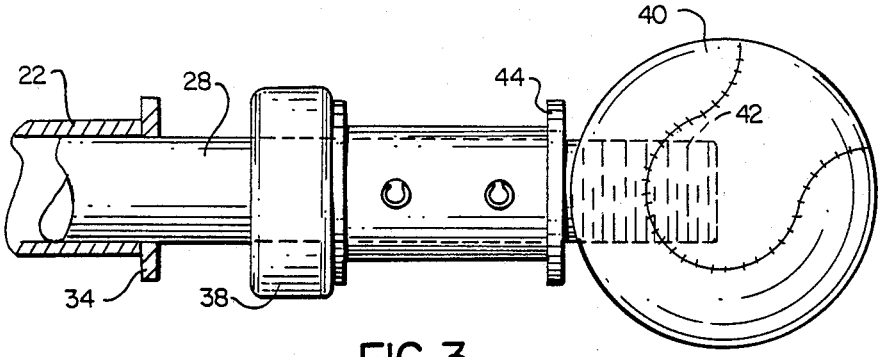
FIG. 3 is an enlarged, fragmentary, side elevational view of portions of the elements seen in FIGS. 1 and 2, partly in section.
Figure 4:
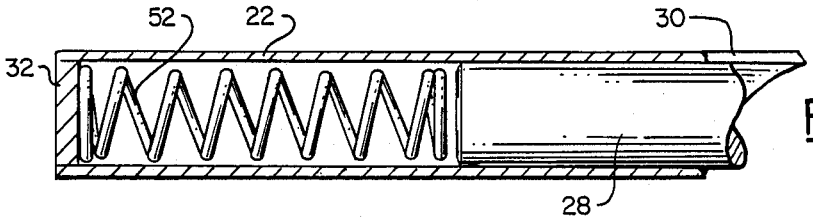
FIG. 4 is a fragmentary, sectional, side elevational view showing the opposite ends of the elements seen in FIG. 3.
Figure 5:
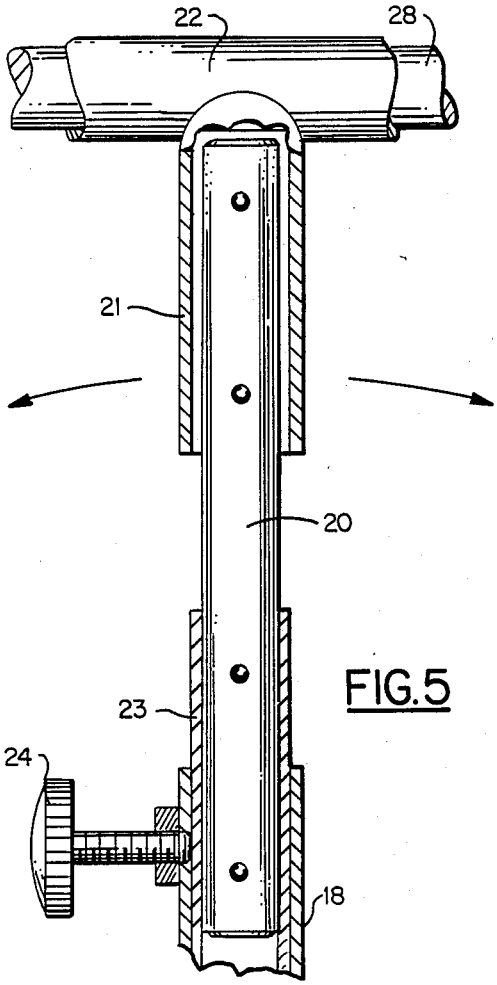
FIG. 5 is a side elevational view showing the height adjustment means of the invention.

Elongated tube 22 is perpendicularly mounted to support rod 20 at the upper end of sleeve portion 21 such that it lies in a substantially horizontal plane upon the desirable placing of base support 10 on a flat, horizontal surface. As best seen in FIGS. 3 & 4, tube 22 is a hollow structure with one open end which coaxially receives slide member 28 for free, reciprocal, sliding movement with respect thereto. Also, the frictional engagement of sleeve 23 by the threaded members attached to clamping knobs 24 and 26 permit sleeve 23, and thus support rod 20 and sleeve 21, to be selectively rotated within rod 18 a predetermined number of degrees to selectively vary the orientation of the axis of slide member 28 with respect to the batter. The selective rotation of support rod 20 within rod 18 permits the batter to practice hitting the baseball at different lateral positions with respect to the batter, as shown in phantom lines in FIGS. 6. Elongated slot 30 is formed in the upper portion of tube 22 between closed end 32 and peripheral flange 34. Pin 36 extends through slot 30 and is threaded into or otherwise affixed to slide member 28. Fixed stop means in the form of peripheral resilient plastic or rubber bumper 38 is provided on the outer end of slide member 28 to limit forward travel thereof. A baseball 40 of the type used in an actual game for which training is undertaken on the apparatus of the invention, is secured directly to the outer, terminal end of slide member 28 by appropriate attachment means. In the illustrated form, baseball 40 is drilled to the center for fixed attachment to post 42, which extends linearly from flange 44.

Figure 6:
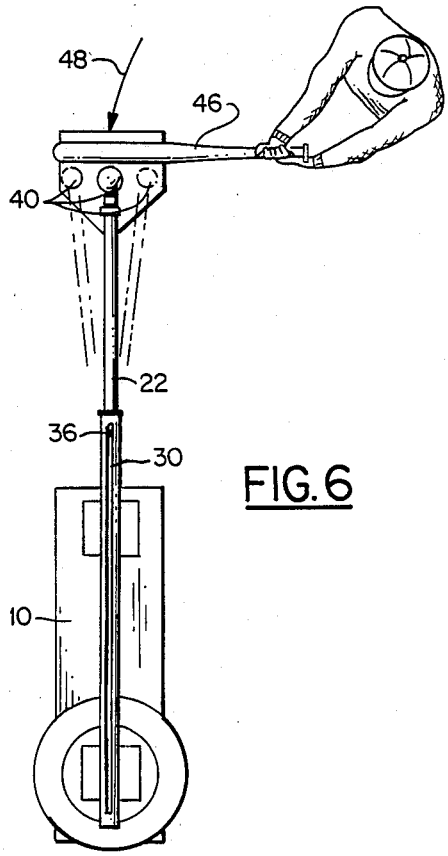
FIGS. 6, 7 and 8 are top views showing a trainee striking the baseball with a bat, with the base support and the horizontal movable element in different relative positions to the batter.
Figure 7:
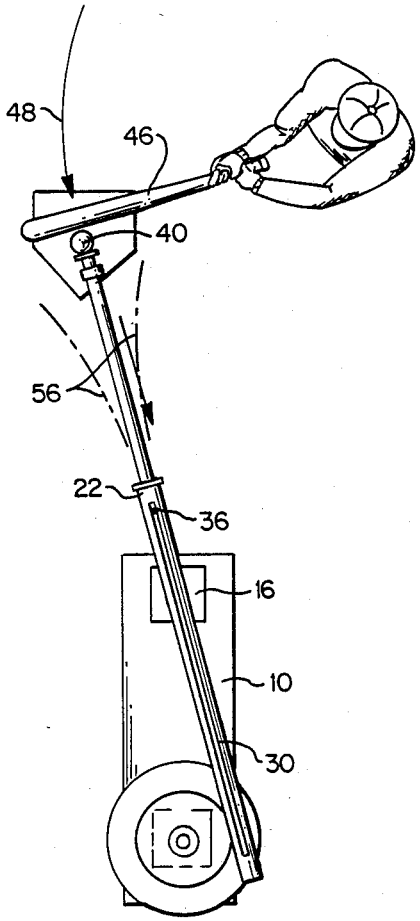
Figure 8:
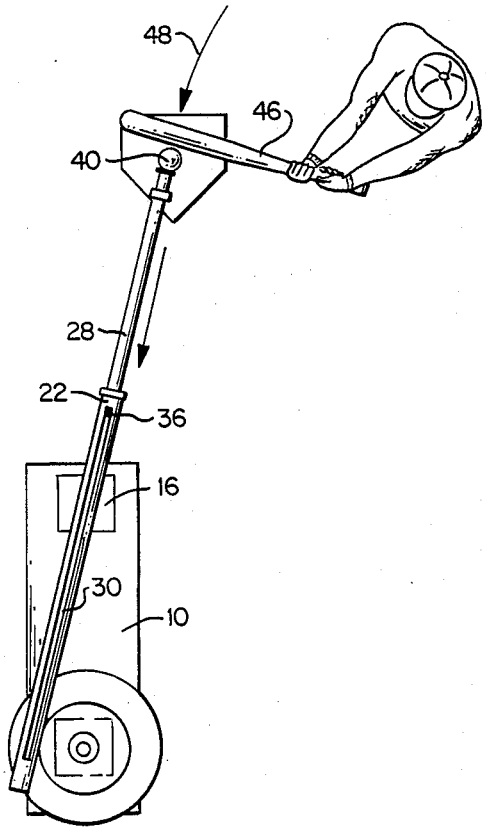

In operation, with baseball 40 attached to the outer end of slide member 28 which is positioned at or near the outer or rearward limit of its movement, as shown in FIG. 1, the batter applies a blow to baseball 40. The blow is applied with a standard baseball bat, as illustrated in FIGS. 6–8 and denoted by reference numeral 46. The bat motion and force applied to the baseball closely simulate actual game conditions and are performed with the same physical movements, thereby using the same muscles and muscle groups employed in making swings of the bat and hits of the ball.

Figure 2:
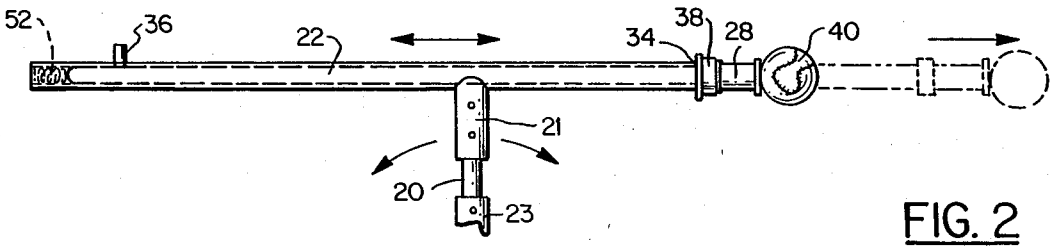
FIG. 2 is a portion of the view of FIG. 1 with the movable element in a second position.

Referring to FIGS. 6, 7, and 8, the movement of bat 46 in an arcuate path, as indicated by arrow 48, to contact baseball 40 imparts movement to slide member 28 in the forward direction indicated by arrow 50. Although forward motion of slide member 28 may be limited by contact of pin 36 with the forward end of slot 30, it is preferred that rubber bumper 38 contact peripheral flange 34 on elongated tube 22 before pin 36 reaches the end of slot 30 in order to minimize the possibility of damage. When slide member 28 approaches the forward limit of its travel, its momentum is transmitted to spring 52 which is compressed by the forceful push exerted upon it by slide member 28. FIG. 4 illustrates initial impact of slide member 28 with spring 52, which is shown in its expanded position. Continued forward movement of slide member 28, the maximum amount thereof limited by contact of bumper 38 with peripheral flange 34 in the position shown in FIG. 2, causes compression of spring 52, thereby providing a rebound force moving slide member 28 back in a rearward direction, which continues until pin 36 contacts the end of slot 30.

In addition to the height adjustment, the horizontal angle of the axis of slide member 28 may be selectively adjusted in the manner previously described to place ball 40 in different positions, as indicated in phantom lines in FIG. 6, thus providing practice in hitting balls in various positions in the strike zone. The lateral position of the base support may be changed, as indicated in FIGS. 7 and 8, to vary the orientation of the line of ball movement with respect to the batter, thereby providing practice in hitting the ball to different parts of the playing field. Also, since the blows imparted to baseball 40 may not be in a direction exactly aligned with the axis of slide member 28, it is preferred that member 28 be of a high strength, essentially rigid, yet somewhat flexible material, such as Dupont's HYTREL plastic. When the ball is struck in a manner which would impart upward or downward movement, the normally linear axis of member 28 may flex to the positions shown in the phantom lines denoted by reference numeral 54 in FIG. 1. Likewise, when the ball is struck in a manner which would cause it to leave the bat in a path to the left or right of the axis of member 28, the member will flex as indicated by phantom lines 56 in FIG. 7. Sleeves 21 and 23 and rod 20 are also preferably of the same or a similar material to permit some shock-absorbing motion in the direction indicated by arrows 58 in FIG. 1.

The training apparatus of the invention offers the trainee an opportunity to make a sustained series of blows to a baseball in rapid succession in a manner closely simulating actual game conditions. The muscles exercised and conditioned are those utilized in making the same type of swing of the bat and hit of the baseball as in an actual game. Also, the movements of the hands, arms, legs and feet, used in swinging at a baseball in actual game conditions are repeatedly rehearsed and thus reinforced. For example, use of the training apparatus to hit the baseball with a bat has been found extremely useful in developing strong swings and wrist roll techniques.

With the automatic rebound action bringing the baseball back to its original position very quickly after being struck, the practice sequence may be repeated at a very rapid pace, aiding in the training and conditioning process. By using the slide member in conjunction with the tube, the initial motion is imparted to the baseball without resistance from the biasing means used to provide the rebound action. Instead of the illustrated spring, an elastic cord or other such means may be utilized to provide the rebound action. Also, it is preferred that the means providing the rebound action be easily removed and replaced with elements providing different degrees of resilience, or otherwise be adjustable to vary the amount of force required to move the slide member to the full extent of its forward motion.

What is claimed is:

1. Apparatus for training a player in baseball, said apparatus comprising:

(a) stationary base structure adapted to rest upon a substantially horizontal surface;

(b) a first support member vertically and fixedly mounted upon said base structure;.

(c) a second support member telescopingly engaged, within said first support member for freely sliding, reciprocal movement with respect thereto;

(d) means for releasably fixing said second support member at a predetermined height and rotational orientation with respect to said first support member;

(e) an elongated, hollow tube perpendicularly and fixedly mounted upon the upper end of said second support member, said tube having an open end and a closed end;

(f) an elongated rod having an inner end telescopingly engaged within said hollow tube open end for freely sliding, reciprocal motion between first and second positions;

(g) a baseball fixedly attached to the outer end of said rod for application of a propelling force by a player, thereby moving said rod from said first to said second position thereof; and (h) resilient return means constructed and arranged to absorb kinetic energy from movement of said rod to said second position and to return a portion of said energy to return said rod toward said first position.

2. The invention according to claim 1 wherein said resilient return means comprises a coil spring positioned within said closed end of said tube.

3. The invention according to claim 1 wherein said releasable fixing means comprises at least one peripheral clamping knob attached to said first support member and frictionally engageable with said second support member.

4. The invention according to claim 1 wherein said second support member includes sleeve portions attached to each end of said second support member, thereby providing additional support structure.

5. The invention according to claim 1 and further including stop means on both said hollow tube and said rod for limiting movement of said rod between said first and said second positions.

6. The invention according to claim 5 wherein said hollow tube includes an elongated slot and said rod includes a pin fixedly attached thereto and extending through and movable within said slot, said pin engaging one end of said slot to provide said stop means defining said first position of said rod.

7. The invention according to claim 5 wherein said tube and said rod further include peripheral flange and bumper means which engages said rod to provide said stop means defining said second position.

* * * * *